US006388574B1

(12) United States Patent
Davis et al.

(10) Patent No.: US 6,388,574 B1
(45) **Date of Patent: *May 14, 2002**

(54) OPTICAL CHASSIS INTRUSION DETECTION WITH POWER ON OR OFF

(75) Inventors: Edward L. Davis, Milwaukie; Benjamin Schafer, Cornelius, both of OR (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/785,818

(22) Filed: Dec. 24, 1996

(51) Int. Cl.[7] ..... G08B 13/14
(52) U.S. Cl. ..... 340/568.1; 340/571; 307/112
(58) Field of Search ..... 340/568.1, 571, 340/555, 545; 250/222.1, 227.15, 214 R, 214 AL; 307/112

(56) References Cited

U.S. PATENT DOCUMENTS 3,704,374 A * 11/1972 Kaufman ..... 250/214 R
4,692,745 A * 9/1987 Simanowitz ..... 340/571
4,791,411 A * 12/1988 Staar ..... 340/568
4,894,527 A * 1/1990 Smith ..... 250/214 AL
5,060,854 A * 10/1991 Armstrong ..... 250/214 AL
5,148,150 A * 9/1992 White et al. ..... 340/571
5,150,101 A * 9/1992 Goris et al. ..... 340/568
5,293,115 A * 3/1994 Swanson ..... 340/568
5,406,260 A * 4/1995 Cummings et al. ..... 340/568
5,412,373 A * 5/1995 Wajda ..... 340/568
5,912,621 A * 6/1999 Schmidt ..... 340/571
6,191,503 B1 * 2/2001 Kitten et al. ..... 307/112

* cited by examiner

*Primary Examiner*—John Tweel
(74) *Attorney, Agent, or Firm*—Kenyon & Kenyon

(57) ABSTRACT

An optical intrusion detection system includes an electromagnetic radiation detector located within the chassis of a personal computer or the like. The EM detector, such as a photodiode or phototransistor, detects EM radiation when the chassis is opened (allowing a person to modify or remove the contents thereof). The EM detector sends a detection signal to a latching mechanism that latches the signal and maintains the signal even after the chassis is closed. A detection component is provided which supplies the detection signal as a data signal to a network administrator terminal coupled to the personal computer where the optical intrusion detection system is installed. A feature of the detection system of the present invention is that intrusion into the chassis is detected silently and without alerting the individual opening the chassis.

15 Claims, 5 Drawing Sheets

OPTICAL CHASSIS INTRUSION DETECTION WITH POWER ON OR OFF

BACKGROUND OF THE INVENTION

The present invention pertains to an apparatus to detect when the chassis of a personal computer or the like has been opened. More particularly, the present invention pertains to a chassis intrusion system that optically detects when the chassis of a personal computer or the like has been opened and stores such an indication.

There are several methods and apparatus known in the art for detecting intrusion into the chassis of a personal computer or other device (e.g., a hard disk drive, a stereo, a video tape recorder, etc.). One of the simplest is the use of a tamper-proof adhesive hologram that is destroyed when removed. Thus, if such an adhesive is appropriately placed at an opening of a chassis or the like, the chassis cannot be opened without leaving an indication that it has been opened. Another device is the so-called "sticky" switch mechanism that moves from a first position to a second position when the chassis is opened. Unfortunately, such a device usually makes a clicking sound, alerting the person opening the chassis to the presence of the intrusion device. Such devices for detecting intrusion are valuable for a variety of reasons. For example, these devices can be used to deter theft of components inside the chassis. Also, these devices can alert a manufacturer that the end user may have improperly attempted to fix a product in violation of the manufacturer's warranty.

A problem that exists with the sticker approach described above, is that once the sticker is removed or cut after being applied, it can no longer be used and requires replacement. Likewise, the mechanical "sticky" switch can be difficult to put together and may require manual assembly (making it a somewhat expensive option). A further problem with these devices is that to detect when a chassis has been opened, one must go to the chassis and inspect the intrusion device.

SUMMARY OF THE INVENTION

The present invention provides for an optical intrusion detection system including an electromagnetic detector having an output, where the electromagnetic detector is capable of sensing and generating a detection signal in response to the presence of electromagnetic radiation within a chassis. A latching mechanism is also provided having an input coupled to the output of the electromagnetic detector and an output, so that the latching mechanism can latch the detection signal at its output.

DETAILED DESCRIPTION

Figure 1:
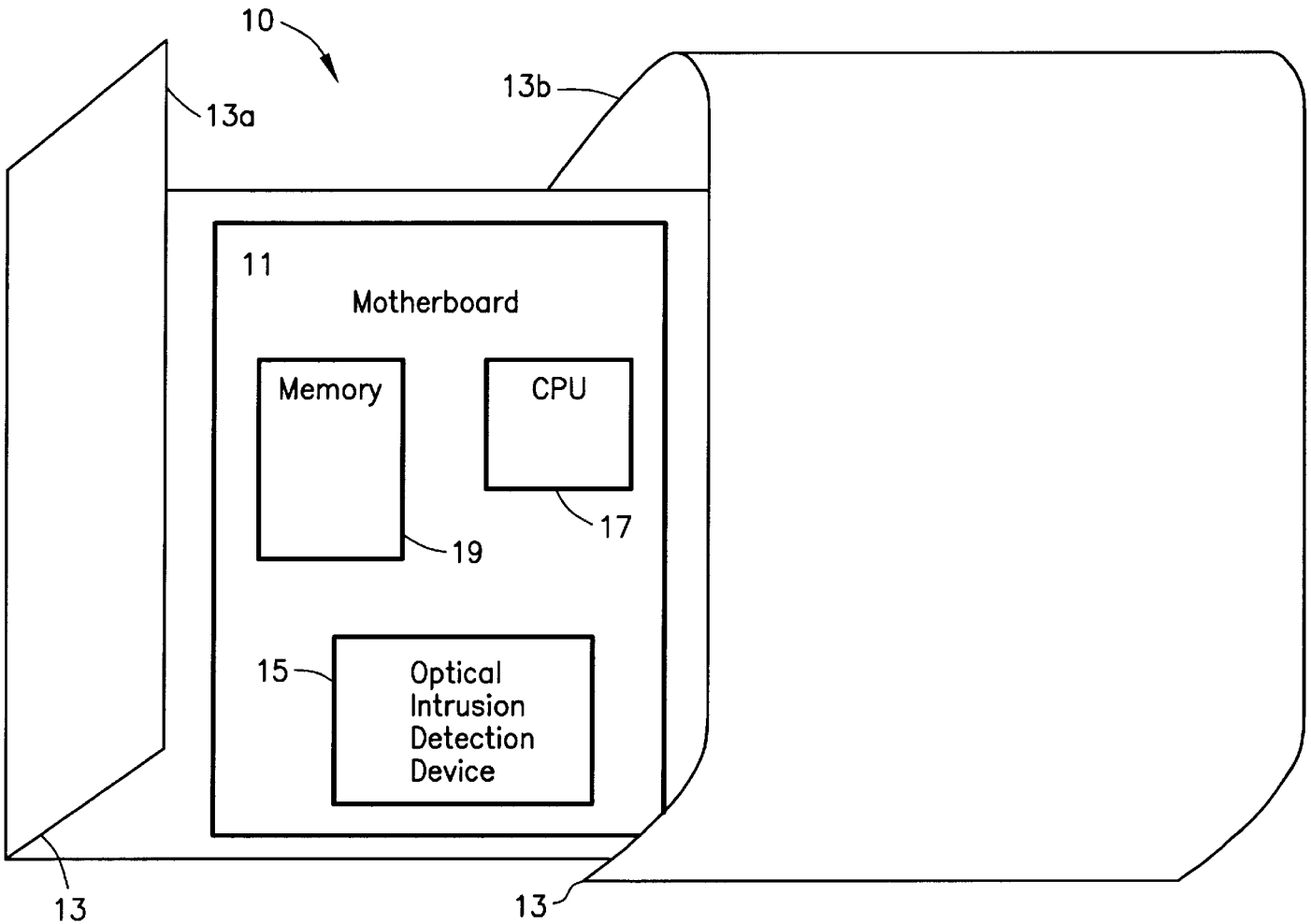
FIG. 1 is a view of a chassis including the optical intrusion detection device of the present invention.

Referring to FIG. 1, a personal computer unit 10 is shown having a chassis 13 that is divided into a inside portion 13*a* and an outside portion 13*b*. As is known in the art, the outside portion 13*b* of the chassis is usually attached to the inside portion 13*b* with screws (not specifically shown in FIG. 1). After the screws are removed, the outside portion 13*b* of the chassis slides away from the inside portion 13*a* of the chassis to expose the motherboard 11 and other components. According to the present invention, an optical intrusion detection device 15 is coupled within chassis 13. In this embodiment of the invention, optical intrusion detection device 15 is coupled to motherboard 11 which includes a Central Processing Unit (CPU) 17 and memory 19.

Figure 2:
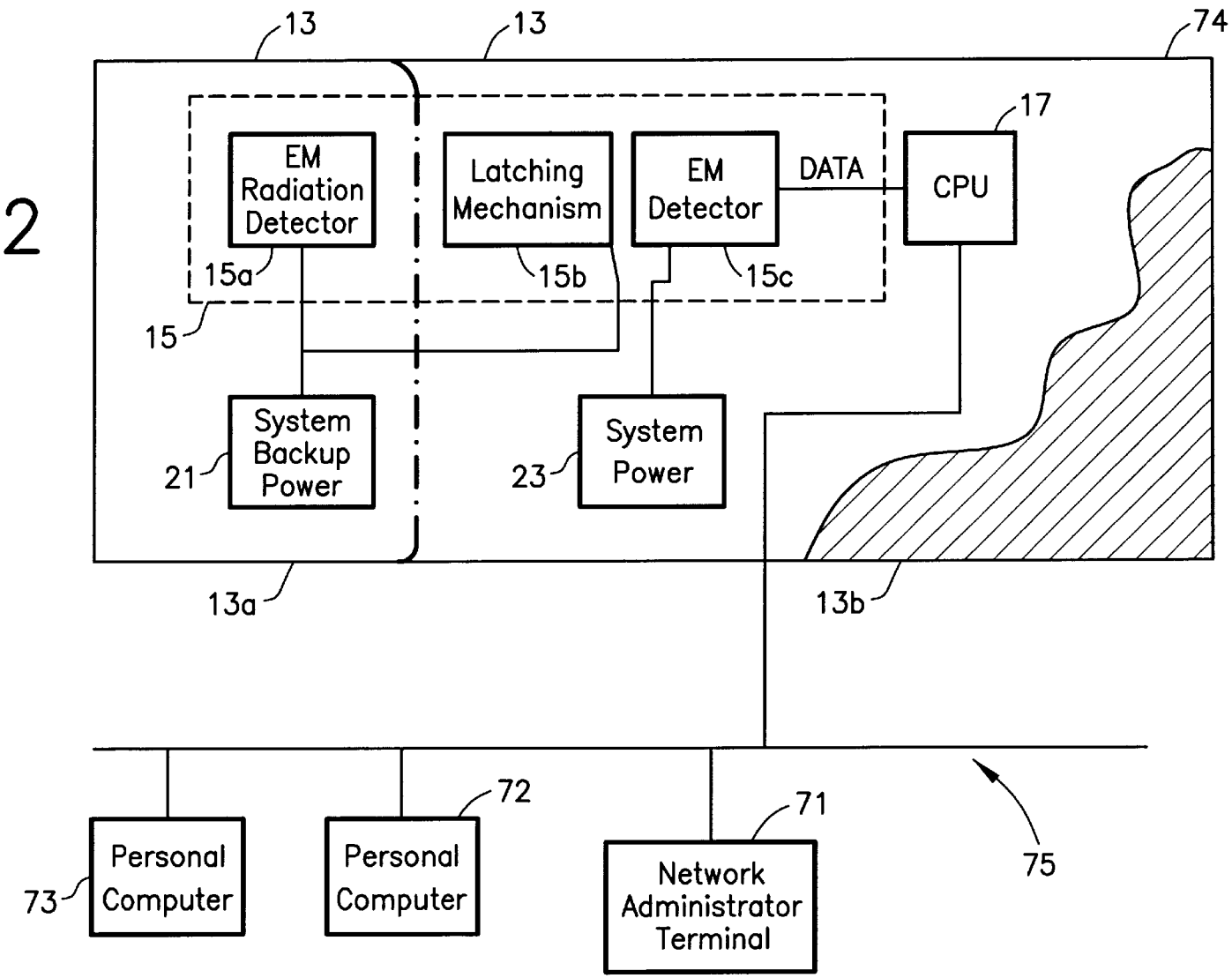
FIG. 2 is a general block diagram of the optical intrusion detection device of the present invention.

Referring to FIG. 2, a general block diagram of the optical intrusion detection system of the present invention is shown. The optical intrusion detection device 15 includes an electromagnetic radiation detector (EM detector) 15*a*, such as a Cadmium Sulfide (CDS) photodiode or a phototransistor. One skilled in the art will appreciate that numerous other EM sensitive devices exist that would work equally as well. The EM detector 15*a* is coupled to a latching mechanism 15*b* which latches a detection signal from the EM detector 15*a*. The detection signal (indicating the presence of EM radiation in chassis 13) stored by the latching mechanism can be supplied as the signal DATA to the system (e.g., to CPU 17) via a detection component 15*c*. The optical intrusion detection device 15 is coupled to system power 23 to assist in driving the output signal data to CPU 17. For the optical intrusion detection device 15 to operate when system power is turned off, system backup power 21 is provided, such as the battery that is commonly coupled to the complementary metal oxide semiconductor (CMOS) chip that stores setup information for power-on self-testing.

When the chassis 13 of the system is closed (that is when outer portion 13*b* and inner portion 13*a* are coupled together), EM detector 15*a* is in relative darkness. After the chassis 13 is opened (that is outer portion 13*b* is separated from inner portion 13*a* ), in all likelihood EM radiation (e.g., visible light) will impinge on EM detector 15*a*. In response, EM detector 15*a* sends a signal to latching mechanism 15*b* indicating the presence of physical light, in this example. The latching mechanism 15*b* latches the signal from the EM detector 15*a* and supplies it as an output signal (OUTPUT) which can be subsequently read by CPU 17.

Figure 3:
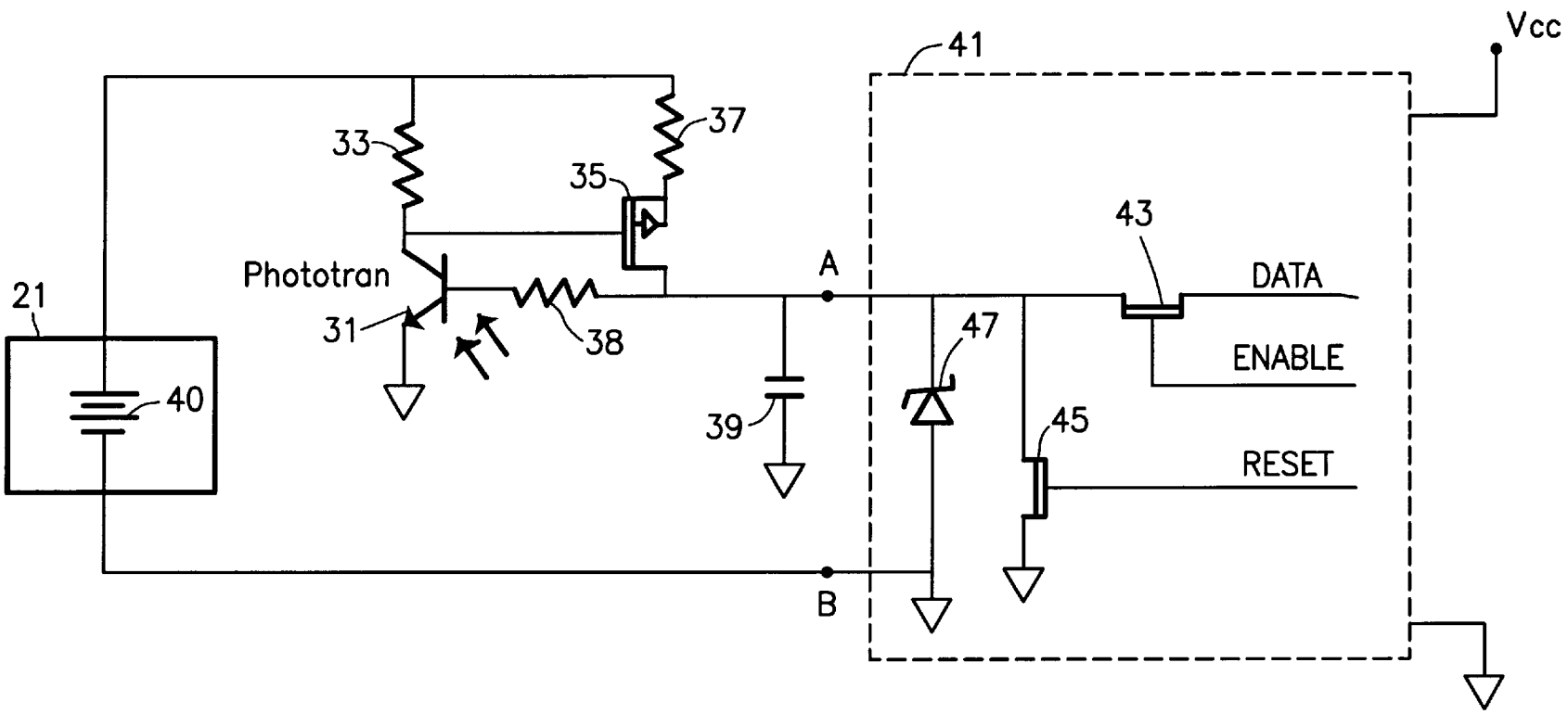
FIG. 3 is a block diagram of a first embodiment of the optical instruction detection device of the present invention.

A more detailed example of the optical intrusion detection system of FIG. 2 is shown in FIG. 3. The optical intrusion detection system includes a phototransistor 31 which is sensitive to incident light (shown as arrows in FIG. 3). The collector terminal of phototransistor 31 is coupled to a first resistor 33 having a resistance of approximately 1–5 Mohms and the gate of a p-channel field-effect transistor (FET) 35. The source terminal of the p-channel FET 35 is coupled to a second resistor 37 having a resistance on the order of 100KOhms. The drain of the p-channel FET 35 is coupled to the base terminal of the phototransistor 31 via a third resistor 38 having a resistance of approximately 1–5 Mohms. A capacitor 39 having a capacitance on the order of 330 picofarads is coupled between the drain terminal of the p-channel FET 35 and ground to provide stabilization during changes in current flow in the circuit (e.g., when light impinges upon phototransistor 31 as described below). A direct current (DC) battery 40 is coupled to the optical intrusion detection system so that it operates at all times, including when the computer is turned off (similar to the system backup power component of FIG. 2). In this embodiment, the DC battery 40 is one that is commonly coupled to the CMOS chip that is used in many personal computers (PCS) to store setup data for power-on self-testing and the like. The positive terminal of DC battery 40 is coupled to the collector of the phototransistor 31 via the first resistor 33 and the source terminal of the p-channel FET 35 via the second resistor 37. The negative terminal of DC battery 40 is coupled to ground. In this embodiment, DC battery 40 supplies approximately 5 volts.

When no light impinges upon phototransistor 31 (i.e., when chassis 13 (FIG. 1) is closed), current from DC battery 40 flows through the first resistor 33 to the gate terminal of the p-channel FET 35 and through the second resistor 37 to the source and drain terminals of the p-channel FET 35. In other words, because phototransistor 31 is not conducting from the collector terminal to the emitter terminal, current flows through the gate terminal of the p-channel FET 35, turning it on, allowing current to flow from the source terminal to the drain terminal. This current also flows to the base terminal of the phototransistor 31, turning it on. Accordingly, the p-channel FET 35 operates to latch phototransistor 31 on. Digitally, there is a logical "1" value at the gate terminal of the p-channel FET 35 and a logical "0" value appears across terminal A and B in FIG. 3.

When chassis 13 is opened (FIG. 1) so that light impinges upon the optical intrusion detection system, phototransistor 31 conducts current from the collector terminal to the emitter terminal. As a result, current previously flowing to the gate terminal of the p-channel FET 35 is reduced, thus turning it off. Little if any current flows from the source terminal to the drain terminal of the p-channel FET 35 which reduces the current flow to the base terminal of the phototransistor 31. This has the effect of latching the phototransistor 31 up, so that the voltage potential across terminals A and B in FIG. 3 will remain high (i.e., at a logic "1" level) even after chassis 13 is closed (placing phototransistor 31 in the dark once again). Accordingly, referring back to FIG. 2, phototransistor 31 serves as part of the EM detector component 15*a* and the p-channel FET 35 serves as part of the latching mechanism 15*b* of the optical intrusion detection system 15.

A detection component 41 can be provided so that the system can detect and reset the logical value appearing across terminals A and B. The voltage potential across terminals A and B will appear at either the source or drain terminal of a second FET 43. If a logic "1" signal is placed at the ENABLE input (which in turn is coupled to the gate terminal of the second FET 43), then the voltage potential across terminals A and B will appear at the DATA output of the second FET 43. When the system comes back on so system power, such as a 5 Volt $V_{cc}$ supply, is turned on, the DATA output can be sampled. The DATA signal line has a very high impedance (on the order of 10 Mohms) with low leakage (on the order of 10 nA, even in the absence of $V_{cc}$). Instead of using the so-called "stacked-diode protection," a zener diode 47 is coupled to the A terminal to protect against discharging of a logic "1" signal appearing across terminals A and B if there is no system voltage $V_{cc}$. If a logic "1" voltage appears across terminals A and B, then that signal can be reset using the RESET input of FIG. 3. The RESET input is coupled to the gate terminal of a third FET 45, so that when a logic "1" signal appears at the RESET input current flows across the source and drain terminals of the third FET 45 causing the potential across terminals A and B to go to a logic "0" value.

Figure 4:
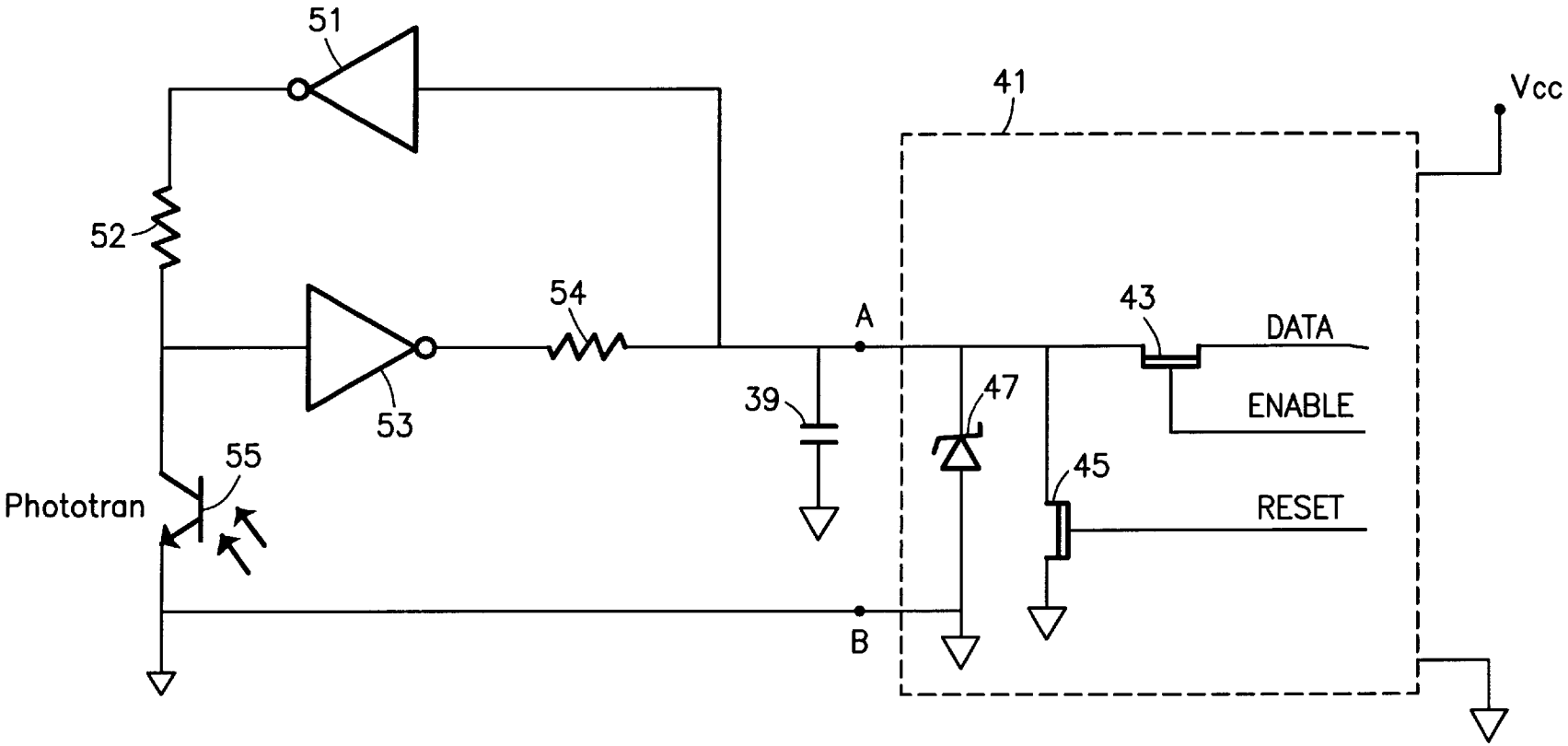
FIG. 4 is a block diagram of a second embodiment of the optical instruction detection device of the present invention.

A second embodiment of the optical intrusion detection system of FIG. 2 is shown in FIG. 4. Components having an operation similar to those in FIG. 3 are given identical reference numbers. In the system of FIG. 4, a first inverter circuit 51 is placed in an antiparallel relationship to a second inverter circuit 53. Accordingly, the output of the first inverter 51 is coupled to the input of the second inverter 53 via a resistor 52, and the output of the second inverter 53 is coupled to the input of the first inverter 51 via a resistor 54. An EM detector circuit, in this case phototransistor 55, is coupled in series to the input of the second inverter 53 and is also coupled to the output of the first inverter circuit 51 (via resistor 52). The inverter circuits are coupled to the system backup battery.

When phototransistor 55 is in the dark, a negligible amount of current flows through it. Thus, the potential across the phototransistor 55 is also negligible. The potential across terminals A and B is also negligible (i.e., a binary "0" value) which is supplied to the input of the first inverter 51. The output of the inverter 51 will have a high value depending on the voltage being supplied to inverter 51. In this example, the system backup battery supplies 5 volts which would appear at the output of the first inverter 51 and at the input of the second inverter 53. The second inverter 53 outputs a low voltage, accordingly. The low voltage across the A and B terminals is supplied to detection circuit 41 as described with reference to FIG. 3.

When light impinges upon phototransistor 55 (e.g., when the chassis of a computer is opened), sufficient current flows through the phototransistor to create a voltage potential across it drawing voltage away from the input to the second inverter 53. In doing so the output of the second inverter 53 goes to a high level (e.g. 5 volts) which in turn is supplied to the input of the first inverter 51, which outputs a low voltage to the input of the second inverter 53. The 5 volt output of the second inverter 53 is supplied across the terminals A and B. This signal is also latched such that when the chassis 13 of the personal computer is closed and the phototransistor 55 is once again placed in the dark, the voltage across terminals A and B will be maintained at a logical "1" value. Accordingly, the phototransistor 55 serves as part of the EM detector component 15*a* and the first and second inverters 51, 53 serves as part of the latching mechanism 15*b* of the optical intrusion detection system 15 (FIG. 2).

Figure 5:
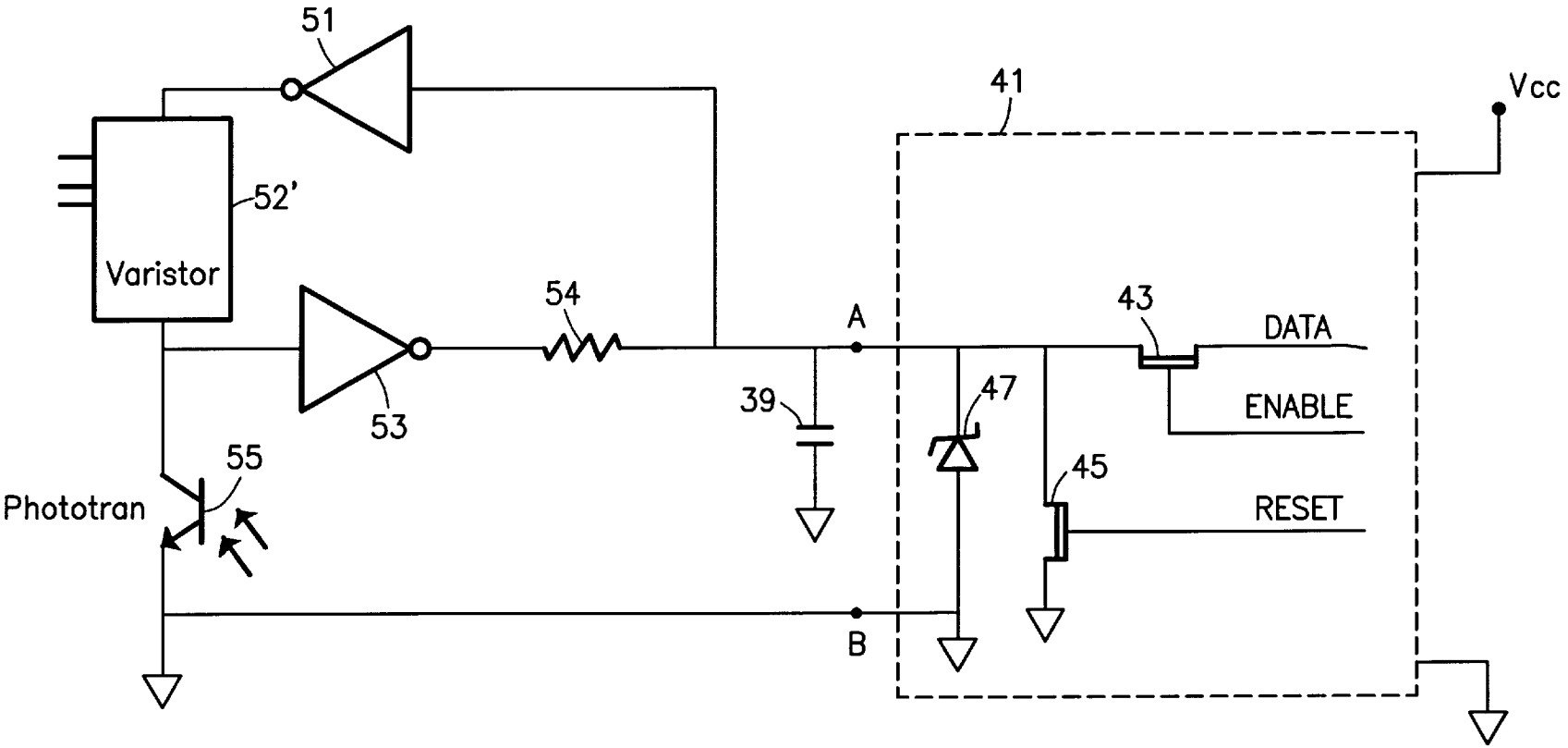
FIG. 5 is a block diagram of a third embodiment of the optical instruction detection device of the present invention.

The sensitivity of the systems of FIGS. 3 and 4 can be altered by making the first resistor 52 a variable resistance device or varistor 52' as shown in FIG. 5. As an example, varistor 52' can have three binary inputs that allow for the selection of one of eight resistances between the output of the first inverter 51 and the input of the second inverter of FIG. 4. In this embodiment, the values for the available resistances in varistor 52' would be between 1 and 5 Mohms. The inputs for the varistor can be coupled directly to the system battery at the time of installation or can be supplied by the CPU 17 or the like. Accordingly, the higher the resistance value selected for varistor 52' the more light that becomes necessary for phototransistor 55 to affect the logic output of the second inverter, and thus the voltage across terminals A and B. In certain computer chassis, it is possible that light will enter the chassis even when the chassis is not opened. By placing two or more optical intrusion detection circuits in the chassis, this problem can be alleviated by not allowing the DATA signal to have a logic "1" value unless all of the detection circuits have detected EM radiation.

According to the present invention, the DATA signal can be detected by the system (e.g., by the CPU 17) which in turn allows a network administrator terminal 71 to be notified immediately via a network, such as local area network (LAN) 75 coupling together personal computers 72–74 (see FIG. 2). Also, the DATA signal can be sent to a network administrator terminal coupled to a wide area network (WAN) or to security personnel via a phone paging system, for example. With the optical intrusion detection system, the security of the components within a computer chassis or the like is improved since tampering with the chassis is detected without reopening it.

Although several embodiments are specifically illustrated and described herein, it will be appreciated that modifications and variations of the present invention are covered by the above teachings and within the purview of the appended claims without departing from the spirit and intended scope of the invention.

What is claimed is:

1. An optical intrusion detection system for placement in a chassis, the optical intrusion detection system comprising:

an electromagnetic radiation detector having an output, where said electromagnetic radiation detector is capable of sensing and generating a detection signal in response to an opening of the chassis enclosing said electromagnetic radiation detector and a presence of ambient electromagnetic radiation within the chassis from outside of the chassis due to said opening of said chassis; and a latching mechanism having an input coupled to the output of said electromagnetic radiation detector and an output, where said latching mechanism is capable of latching said detection signal at its output.

2. The optical intrusion detection system of claim 1 wherein said detection signal is present at the output of said latching mechanism after the presence of electromagnetic radiation at said electromagnetic radiation detector is removed.

3. The optical intrusion detection system of claim 1 wherein said chassis is a computer, the system further comprising:

a system backup battery coupled to said electromagnetic radiation detector and said latching mechanism, where said detection signal is latched by said latching mechanism while said personal computer is powered off.

4. The optical intrusion detection system of claim 2 wherein said chassis is a computer, the system further comprising:

a battery coupled to said electromagnetic radiation detector and said latching mechanism, where said detection signal is latched by said latching mechanism while said computer is powered off.

5. The optical intrusion detection system of claim 1 wherein said electromagnetic radiation detector includes a phototransistor.

6. The optical intrusion detection system of claim 4 wherein said electromagnetic radiation detector includes a phototransistor.

7. The optical intrusion detection system of claim 6 wherein said phototransistor includes a collector terminal coupled to a positive terminal of said battery via a first resistor and a base terminal and said latching mechanism includes a p-channel field-effect transistor having a gate terminal coupled to the collector terminal of said phototransistor, a drain terminal coupled to the base terminal of said phototransistor, and a source terminal coupled to the positive terminal of said battery, such that said detection signal appears at the drain terminal of said p-channel field-effect transistor.

8. The optical intrusion detection system of claim 6 wherein said phototransistor includes a collector terminal and said electromagnetic radiation detector further includes a first resistor coupled to the collector terminal of said phototransistor, said latching mechanism includes a first inverter having an output coupled to said first resistor and an output, a second inverter having an input coupled to the collector terminal of said phototransistor and the output of said first inverter via said first resistor and an output coupled to the input of said first inverter via a second resistor, such that said detection signal appears at the input of said first inverter.

9. The optical intrusion detection system of claim 8 wherein said first resistor is a varistor, such that a sensitivity of said phototransistor is dependent upon a selected resistance of said varistor.

10. The optical intrusion detection system of claim 1 further comprising:

a detection component having an input coupled to said latching mechanism and an output, said detection component providing said detection signal as a data signal to its output.

11. The optical intrusion detection system of claim 6 further comprising:

a detection component having an input coupled to said latching mechanism and an output, said detection component providing said detection signal as a data signal to its output.

12. The optical intrusion detection system of claim 10 wherein said chassis is a personal computer coupled to a network and said data signal is received by a network administrator terminal coupled to said network via said detection component.

13. The optical intrusion detection system of claim 11 wherein said personal computer is coupled to a network and said data signal is received by a network administrator terminal coupled to said network via said detection component.

14. A method of detecting intrusion into a chassis, comprising:

sensing a presence of ambient electromagnetic radiation an opened chassis from outside of the chassis due to an opening of said chassis by an electromagnetic radiation detector;

generating a detection signal with said electromagnetic radiation detector; and latching said detection signal at an output of a latching mechanism coupled to said electromagnetic radiation detector.

15. An optical intrusion detection system for a computer comprising:

a computer including a chassis enclosing a motherboard and an optical intrusion detection device, the optical intrusion detection device includes an electromagnetic radiation detector having an output, where said electromagnetic radiation detector is capable of sensing and generating a detection signal in response to an opening of said chassis and a presence of ambient electromagnetic radiation within said chassis from outside of the chassis due to the opening of said chassis; and a latching mechanism having an input coupled to the output of said electromagnetic radiation detector and an output, where said latching mechanism is capable of latching said detection signal at its output, said detection signal is present at the output of said latching mechanism after the presence of electromagnetic radiation at said electromagnetic radiation detector is removed.

* * * * *

UNITED STATES PATENT AND TRADEMARK OFFICE

CERTIFICATE OF CORRECTION

PATENT NO. : 6,388,574 B1 
DATED : May 14, 2002
INVENTOR(S) : Edward L. Davis and Benjamin Schafer It is certified that error appears in the above-identified patent and that said Letters Patent is hereby corrected as shown below:

Column 6,
Line 37, "radiation an opened chassis" should be -- radiation within an opened chassis --

Signed and Sealed this

Twenty-fifth Day of March, 2003

JAMES E. ROGAN
*Director of the United States Patent and Trademark Office*